US006699020B1

(12) United States Patent
Lin

(10) Patent No.: US 6,699,020 B1
(45) Date of Patent: Mar. 2, 2004

(54) FAN ASSEMBLY WITH LUBRICANT-CONTAINING BEARINGS

(76) Inventor: Hao-Cheng Lin, No. 281, Hsi-Ning S. Rd., Wan-Hwa Dist., Taipei City (TW)

( * ) Notice: Subject to any disclaimer, the term of this patent is extended or adjusted under 35 U.S.C. 154(b) by 28 days.

(21) Appl. No.: 10/228,937

(22) Filed: Aug. 27, 2002

(51) Int. Cl.[7] ..... F04B 35/04; F16C 33/10

(52) U.S. Cl. ..... 417/354; 417/423.13; 415/229; 384/286; 384/397

(58) Field of Search ..... 417/354, 423.12, 417/423.13; 415/220, 229; 384/286, 322, 397

(56) References Cited

U.S. PATENT DOCUMENTS 5,947,704 A * 9/1999 Hsieh ..... 417/423.12
6,102,675 A * 8/2000 Hsieh ..... 417/423.13
6,183,221 B1 * 2/2001 Hsieh ..... 417/423.12
6,567,268 B1 * 5/2003 Hsieh ..... 361/695
6,616,422 B2 * 9/2003 Hsieh ..... 417/354

* cited by examiner

*Primary Examiner*—Charles G. Freay
(74) *Attorney, Agent, or Firm*—Christensen O'Connor Johnson Kindness PLLC

(57) ABSTRACT

A fan assembly includes a mounting tube having an annular flange extending radially and inwardly from an inner wall surface thereof. A rotor includes a rotor shaft extending into the mounting tube. First and second bearings are sleeved on the rotor shaft, and each has an abutment plate, and a peripheral flange that extends axially from the abutment plate, that slidably contacts the inner wall surface of the mounting tube, and that cooperates with the rotor shaft and the abutment plate to define a lubricant-receiving reservoir thereamong. Two annular bearing-covering caps are sleeved on the rotor shaft to sealingly cover the lubricant-receiving reservoirs in the first and second bearings.

3 Claims, 6 Drawing Sheets

FAN ASSEMBLY WITH LUBRICANT-CONTAINING BEARINGS

BACKGROUND OF THE INVENTION

1. Field of the Invention

The present invention relates to a fan assembly, more particularly to a fan assembly which is provided with lubricant-containing bearings so as to prolong the service life thereof.

2. Description of the Related Art

Referring to FIGS. 1 and 2, a conventional fan assembly is shown to include a mounting member 11, a stator 12, a rotor 13, and a tubular bearing 122. The mounting member 11 defines an axially extending bore 112, and includes an annular mounting plate 111 disposed in the bore 112, a plurality of ribs 113 extending radially and outwardly from the mounting plate 111 to connect with a bore-defining wall surface that confines the bore 112 so as to form a plurality of ventilation holes 112", and a mounting tube 115 that extends axially from the mounting plate 111 and that has an inner wall surface to confine a bearing-receiving space. The stator 12 is sleeved securely on the mounting tube 115, and has a plurality of coils 123. The rotor 13 includes a generally U-shaped rotor casing 131, a rotor shaft 134, and a plurality of blades 133. The rotor casing 131 is disposed in the bore 123, and surrounds the stator 12. The rotor shaft 134 extends axially from the rotor casing 131, and is inserted rotatably and co-axially into the bearing-receiving space of the mounting tube 115. The blades 133 extend radially and outwardly from the rotor casing 131. A magnetic sleeve 132 is disposed within the rotor casing 131 around the stator 12. A tubular bearing 122 is disposed in the bearing-receiving space of the mounting tube 115, and is sleeved on the rotor shaft 134. A C-shaped fastener clip 135 is mounted on the rotor shaft 134 to prevent disengagement of the rotor 13 relative to the stator 12.

Some disadvantages resulting from the use of the aforementioned conventional fan assembly are as follows:

(1) The service life of the conventional fan assembly is short, because the lubricant disposed in the tubular bearing 122 gradually diminishes since no covering means is provided to prevent loss of the lubricant.

(2) Provision of such covering means results in increased manufacturing costs.

(3) Since the entire inner wall surface of the bearing 122 slidably contacts the rotor shaft 134, the force of friction therebetween is relatively large.

SUMMARY OF THE INVENTION

Therefore, the object of this invention is to provide a fan assembly with lubricant-containing bearings of a simple construction so as to eliminate the aforesaid disadvantages of the prior art.

Accordingly, a fan assembly according to the present invention includes: a mounting frame, a stator, a rotor, first and second bearings, and first and second annular bearing-covering caps. The mounting frame includes a mounting plate, and a hollow mounting tube extending transversely from the mounting plate. The mounting tube has an inner wall surface confining a bearing-receiving space, and an annular flange that projects inwardly and radially from the inner wall surface into the bearing-receiving space, and that has two opposite sides and two opposite annular side faces. The stator is sleeved securely on the mounting tube. The rotor includes an annular rotor casing, a rotor shaft, and a plurality of blades. The rotor casing surrounds the stator. The rotor shaft extends axially from the rotor casing, and is inserted rotatably into the mounting tube. The blades extend radially and outwardly from the rotor casing. The first and second bearings are respectively disposed at the opposite sides of the annular flange within the bearing-receiving space in the mounting tube, and are sleeved on the rotor shaft. Each of the first and second bearings has a U-shaped cross section, an annular abutment plate that abuts against a respective one of the annular side faces of the annular flanges of the mounting tube, and a peripheral flange that extends axially from the abutment plate, that slidably contacts the inner wall surface of the mounting tube, and that cooperates with the rotor shaft and the abutment plate to define a lubricant-receiving reservoir thereamong. The first and second annular bearing-covering caps are snugly fitted into the bearing-receiving space in the mounting tube, are sleeved on the rotor shaft, and respectively and sealingly cover the lubricant-receiving reservoirs in the first and second bearings.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
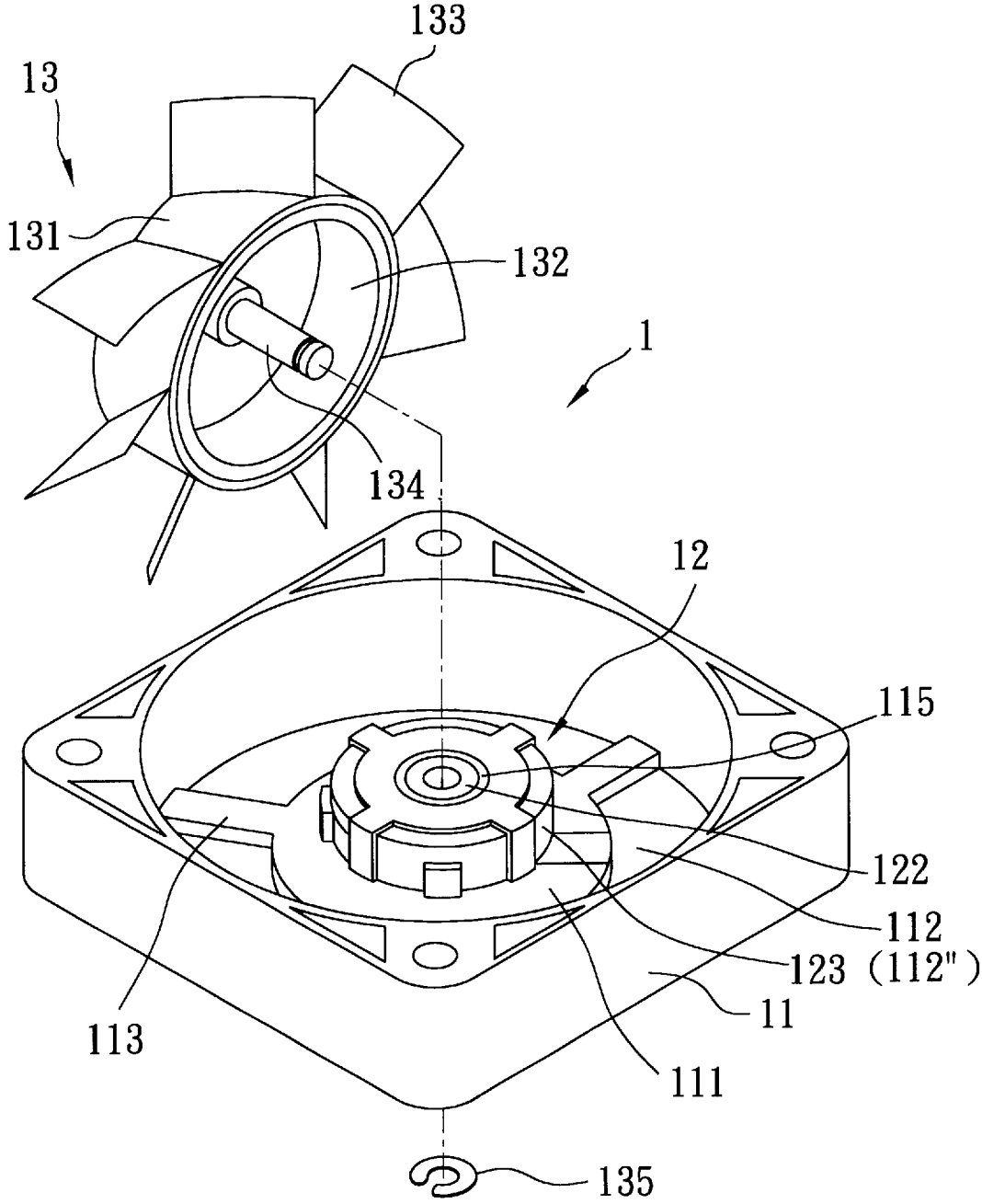
FIG. 1 PRIOR ART
FIG. 1 is an exploded perspective view of a conventional fan assembly.
Figure 2:
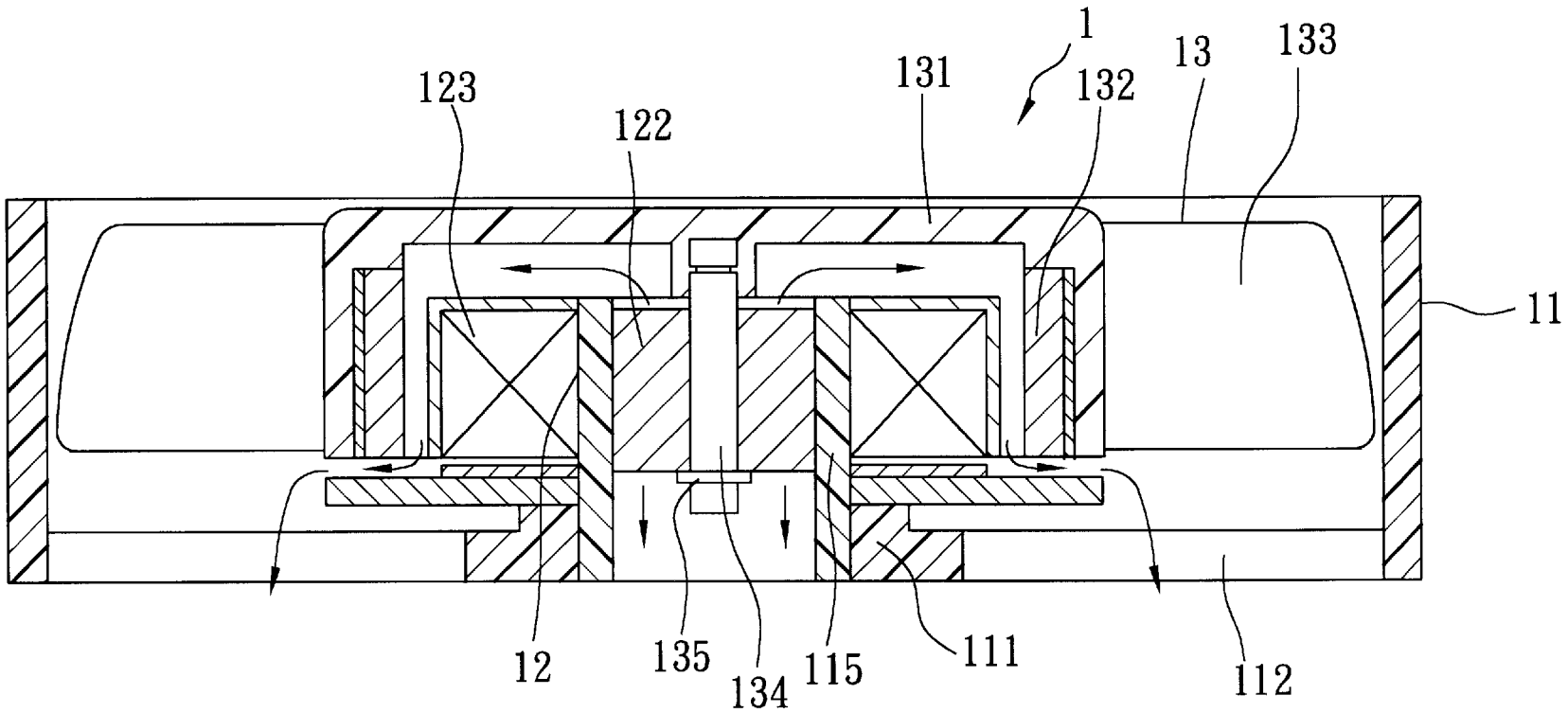
FIG. 2 PRIOR ART
FIG. 2 is a sectional view of the conventional fan assembly, illustrating how a lubricant is spilled outwardly from a bearing during rotation of a rotor.
Figure 3:
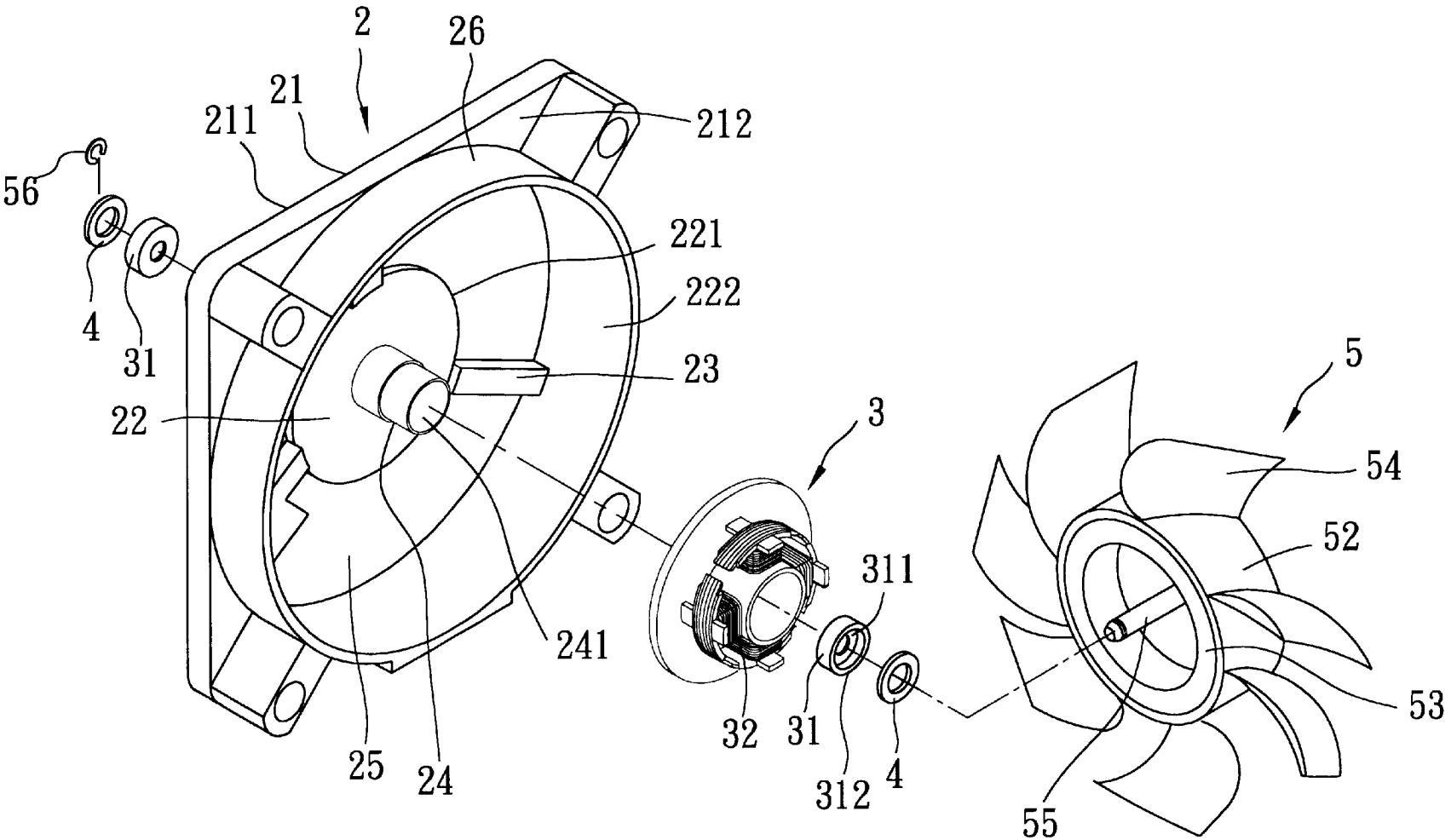
FIG. 3 is an exploded perspective view of the first preferred embodiment of a fan assembly according to the present invention.
Figure 4:
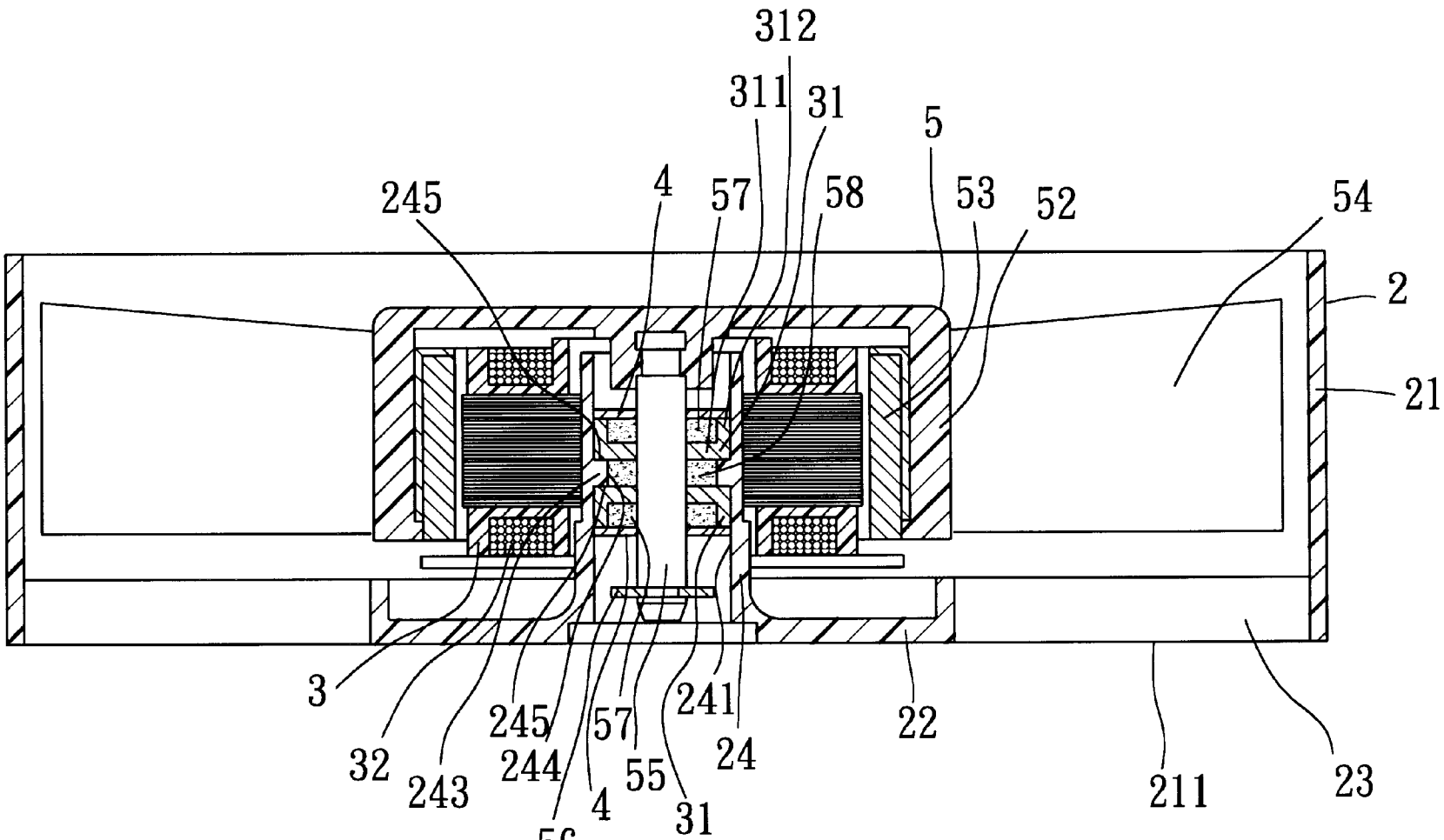
FIG. 4 is a sectional view of the first preferred embodiment, illustrating how two lubricant-containing bearings are disposed in a mounting tube.

Referring to FIGS. 3 and 4, the first preferred embodiment of a fan assembly according to the present invention is shown to include a mounting frame 2, a stator 3, a rotor 5, first and second bearings 31, and first and second annular bearing-covering caps 4.

As illustrated, the mounting frame 2 includes a mounting plate 21 with opposing front and rear sides 211, 212, a hollow mounting tube 24 extending transversely and rearwardly from an annular central portion 22 of the mounting plate 21, a surrounding wall 26 extending transversely and rearwardly from the mounting plate 21, surrounding the mounting tube 24, and cooperating with the annular central portion 22 to define a chamber 222 therebetween, and a plurality of ribs 23 extending radially and outwardly from a periphery 221 of the annular central portion 22 to connect with the surrounding wall 26 so as to define a plurality of ventilation holes 25. The mounting tube 24 defines a bearing-receiving space 244, and has an inner wall surface 241 confining the bearing receiving space 244, and an annular flange 243 that projects inwardly and radially from the inner wall surface 241 into the bearing-receiving space 244 and that has two opposite sides and two opposite annular side faces 245.

The stator 3 is disposed in the chamber 222, is sleeved securely on the mounting tube 24, and has a plurality of coils 32. Since the stator 3 is not a characterizing feature of the present invention, a detailed description of the same will be omitted herein for the sake of brevity.

The rotor 5 includes a rotor casing 52, a rotor shaft 55, and a plurality of blades 54. The rotor casing 52 is disposed in the chamber 222, and surrounds the stator 3. The rotor shaft 55 extends axially from the rotor casing 52, and is inserted rotatably into the mounting tube 24. The blades 54 extend radially and outwardly from the rotor casing 52. A magnetic sleeve 53 is disposed within the rotor casing 52 around the stator 3.

The first and second bearings 31 are respectively disposed at the opposite sides of the annular flange 243 within the bearing-receiving space 244 in the mounting tube 24, and are sleeved on the rotor shaft 55. Each of the first and second bearings 31 has a U-shaped cross section, an annular abutment plate 311 that abuts against a respective one of the annular side faces 245 of the annular flanges 243 of the mounting tube 24, and a peripheral flange 312 that extends axially from the abutment plate 311, that slidably contacts the inner wall surface 241 of the mounting tube 24, and that cooperates with the rotor shaft 55 and the abutment plate 311 to define a lubricant-receiving reservoir 57 thereamong. A proper amount of Lubricating grease is disposed in the lubricant-receiving reservoir 57.

The first and second annular bearing-covering caps 4 are snugly fitted into the bearing-receiving space 244 of the mounting tube 24, are sleeved on the rotor shaft 55, and respectively and sealingly cover the lubricant-receiving reservoirs 57 in the first and second bearings 31.

A C-clip 56 is disposed around the rotor shaft 55, engages a base plate of the stator 3 to prevent disengagement of the rotor 5 relative to the stator 3.

The abutment plates 311 of the first and second bearings 31 cooperate with the annular flange 243 of the mounting tube 24 and the rotor shaft 55 to define an auxiliary lubricant-receiving reservoir 58 thereamong. A proper amount of lubricating grease is disposed within the auxiliary lubricating-receiving reservoir 58.

The rotor shaft 55 contacts slidably a small portion of the abutment plates 311 of the first and second bearings 31 during rotation. As such, little friction force is generated, which is contrast to the prior art.

Note that the first and second bearings 31, and the annular bearing-covering caps 4 are simple and inexpensive to manufacture. The object of the present invention is thus achieved.

Figure 5:
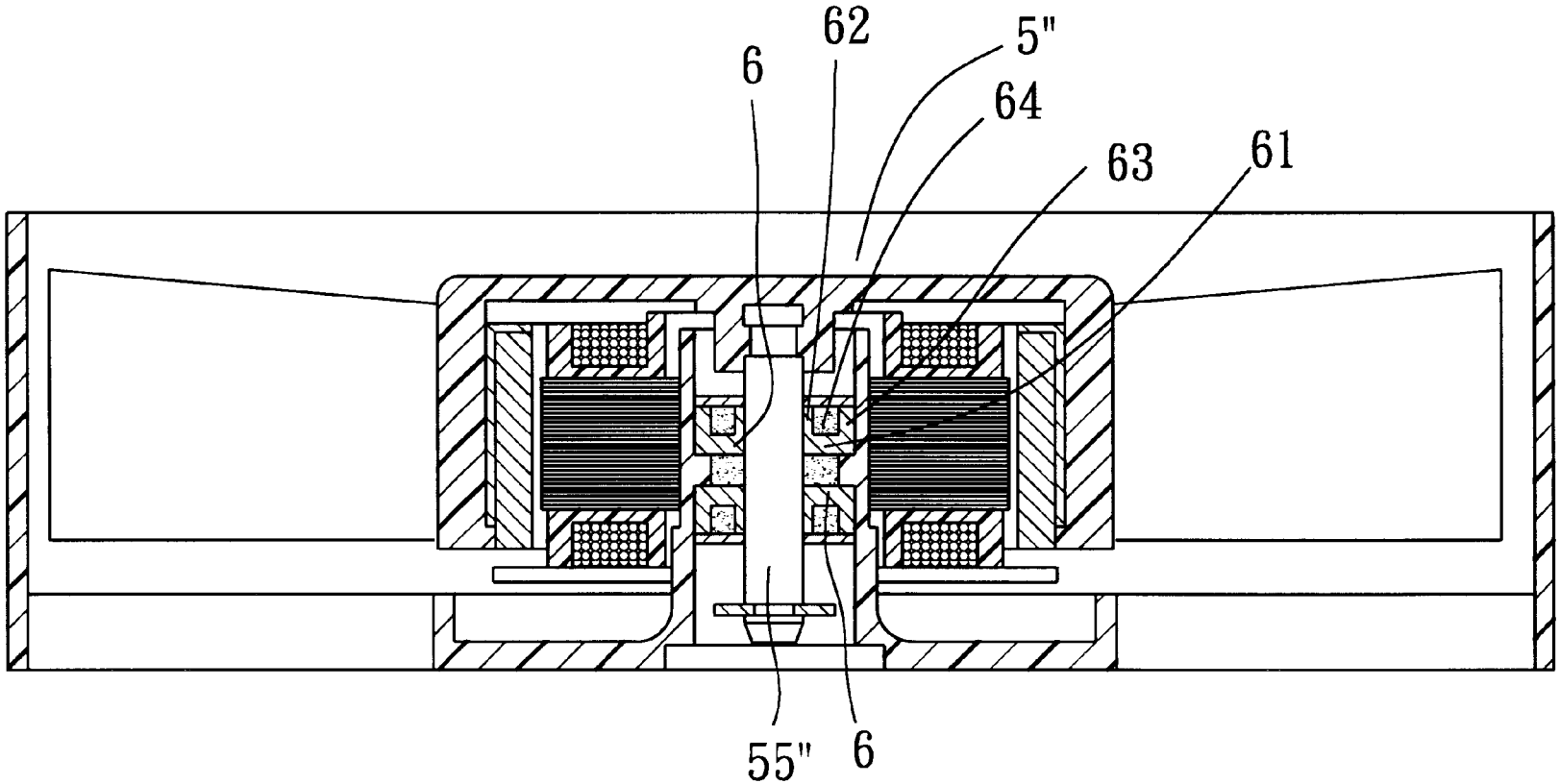
FIG. 5 is a sectional view of the second preferred embodiment of the fan assembly.
Figure 6:
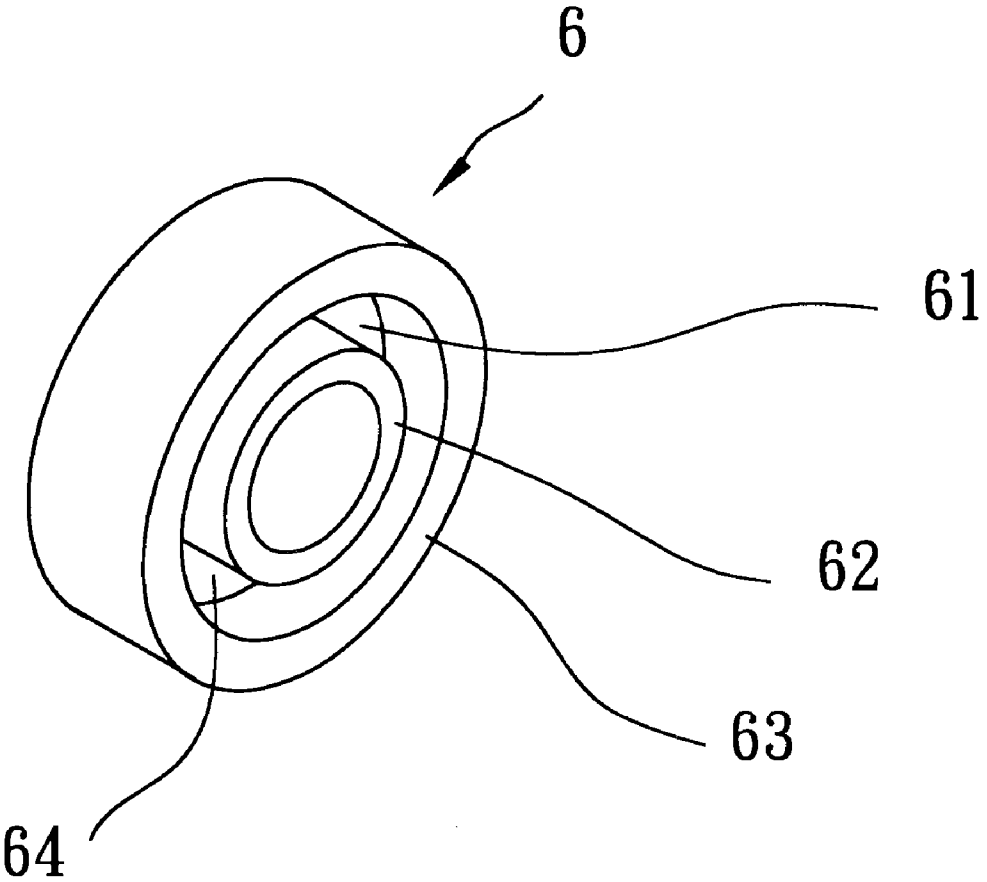
FIG. 6 is an enlarged perspective view of a lubricant-containing bearing employed in the second preferred embodiment.

Referring to FIGS. 5 and 6, the second preferred embodiment of the fan assembly according to the present invention is shown to have a structure similar to the previous embodiment. The main difference resides in that each of first and second bearings 6 includes an inner flange 62 that extends axially from the abutment plate 61 of a respective one of the first and second bearings 6, that is sleeved on the rotor shaft 55" of the rotor 5", and that cooperates with the abutment plate 61 and the peripheral flange 63 of a respective one of the first and second bearings 6 to define the lubricant-receiving reservoir 64 thereamong.

With this invention thus explained, it is apparent that numerous modifications and variations can be made without departing from the scope and spirit of this invention. It is therefore intended that the invention be limited only as indicated in the appended claims.

I claim:

1. A fan assembly comprising:

a mounting frame including a mounting plate, and a hollow mounting tube extending transversely from said mounting plate, said mounting tube having an inner wall surface confining a bearing receiving space, and an annular flange projecting inwardly and radially from said inner wall surface into said bearing-receiving space and having two opposite sides and two opposite annular side faces;

a stator sleeved securely on said mounting tube;

a rotor including an annular rotor casing surrounding said stator, a rotor shaft that extends axially from said rotor casing and that is inserted rotatably into said mounting tube, and a plurality of blades extending radially and outwardly from said rotor casing;

first and second bearings disposed at said opposite sides of said annular flange within said bearing-receiving space and sleeved on said rotor shaft, each of said first and second bearings having a U-shaped cross section, an annular abutment plate that abuts against a respective one of said annular side faces of said annular flanges of said mounting tube, and a peripheral flange that extends axially from said abutment plate, that slidably contacts said inner wall surface of said mounting tube, and that cooperates with said rotor shaft and said abutment plate to define a lubricant-receiving reservoir thereamong; and first and second annular bearing-covering caps snugly fitted into said bearing-receiving space, sleeved on said rotor shaft, and respectively and sealingly covering said lubricant-receiving reservoirs of said first and second bearings.

2. The fan assembly as defined in claim 1, wherein said annular abutment plates of said first and second bearings cooperate with said annular flange of said mounting tube and said rotor shaft to confine an auxiliary lubricant-receiving reservoir thereamong.

3. The fan assembly as defined in claim 1, wherein each of said first and second bearings further includes an inner flange that extends axially from said abutment plate of a respective one of said first and second bearings, that is sleeved on said rotor shaft, and that cooperates with said abutment plate and said peripheral flange of a respective one of said first and second bearings to confine said lubricant-receiving reservoir thereamong.

* * * * *